US005088218A

United States Patent [19]

Liu

[11] Patent Number: 5,088,218

[45] Date of Patent: Feb. 18, 1992

[54] STRUCTURE OF THE ROTARY TYPE CRYSTAL BALL

[76] Inventor: J. H. Liu, No. 3, Alley 202, Kao-Fon Rd., Hsin-Chu City, Taiwan

[21] Appl. No.: 563,614

[22] Filed: Aug. 7, 1990

[51] Int. Cl.[5] ..... G09F 19/08

[52] U.S. Cl. ..... 40/411; 446/236; 272/31 R; 84/95.2; 74/63

[58] Field of Search ..... 40/409, 410, 411, 414, 40/423, 430, 440, 473; 446/236, 265, 267; 272/31 R; 84/94.1, 94.2, 95.1, 95.2; 74/63; 464/157, 162, 185

[56] References Cited

U.S. PATENT DOCUMENTS

| | | | |
|---|---|---|---|
| 2,892,327 | 6/1959 | Kressin | 464/157 |
| 4,757,986 | 7/1988 | Hwang et al. | 272/31 R |
| 4,771,902 | 9/1988 | Teng | 40/410 |

FOREIGN PATENT DOCUMENTS

| | | |
|---|---|---|
| 07/563621 | 11/1989 | Taiwan . |
| 599870 | 3/1948 | United Kingdom . |

OTHER PUBLICATIONS

Drawing of Prior Art showing Elastic Drive Train (Fig. 5).

*Primary Examiner*—Kenneth J. Dorner
*Assistant Examiner*—Brian K. Green
*Attorney, Agent, or Firm*—Larson and Taylor

[57] ABSTRACT

The invention relates to an improved structure of a water-filled rotary type crystal ball. Its major structure includes the elements of a rotary disc, a fixed base, a rubber plug, an elastic axle, and a drive shaft. By means of the above structure, when the range of hot expansion and cold shrinkage of the clear water in the crystal ball is quite large, the expansion or shrinkage will be absorbed by the rubber plug and drive shaft so that the crystal ball will not leak and the drive shaft will not interfere with the normal state of rotation or break down. Also, the structure of the invention permits an easy and simple assembling process so that the manufacturing costs of the components are greatly reduced.

10 Claims, 4 Drawing Sheets

STRUCTURE OF THE ROTARY TYPE CRYSTAL BALL

FIELD OF THE INVENTION

The present invention relates to rotary type crystal balls. In particular, the present invention relates to crystal balls utilizing the spring of a musical bell or box as the power source.

BACKGROUND OF THE INVENTION

The structure of the conventional rotary type crystal ball utilizing the spring of a music bell, or music box, as the power source is shown in FIG. 5. Because of its structural characteristics, such a design will have at least the following defects which are not easy to overcome.

1. When there is insufficient water pressure in the crystal ball, because the rubber plug is made of elastic material and is driven by the gears (not driven directly by the central axis), if the driving gear and the driven gear become slightly off-center or eccentric during assembly, the rotary disc in the drive chain will be unable to keep a normal position or will begin to oscillate. Thus it will not only cause the decorative article in the crystal ball to oscillate, but also will increase the resistance to the rotation of the driving shaft, thereby shortening the rotating life of the crystal ball.

2. The crystal ball is also affected by the heated expansion and cooled shrinkage of the water, which causes the state of insufficient water pressure as above described. If the environmental temperature around the crystal ball decreases, the water pressure in the crystal ball will decrease accordingly. This results in the bowing or hollowing inwardly of the rubber plug, whereby the above described oscillating state of the rotary disc will become more serious.

3. Because of the ready occurrence of the oscillating state and its visually unpleasant appearance, one considers matching the size of the decorative article on the rotary disc with the size of the rotary disc. In principle, it is usual to give the largest diameter to the rotary disc as possible. If a rotary disc having a smaller diameter is fitted with a decorative article having a diameter larger than the disc diameter, the article will easily ram into the fixed base at the edge of the rotary disc. On the other hand, the result of too large a rotary disc (usually the total size of the rotary disc and the edge of the fixed base is equal to the diameter of the rubber plug), will cause the rubber plug to suppress its flange to separate from fixed groove of the glass ball. This results from the close contact of the edge of the rotary disc to that of the rubber plug. When the clear water in the crystal ball expands from a higher environmental temperature, the rubber plug cannot effectively expand to protrude outwardly, whereby the clear water seeps out. After the clear water has seeped out, when the environmental temperature resumes to the original level or decreases, the water pressure will be insufficient, thus causing the defects of the oscillations of the rotary disc, as described in item 2.

4. As to the above described conventional crystal ball, in order to have a smooth and labor-saving rotation of the rotary disc, it can not be allowed to have too much deviation in the space between the driving shaft and the driven shaft when being assembled for operating. Hence the speed of assembling and its undesirable effects will be greatly affected by the result of such precise demands, Furthermore, the unit cost will be definitely increased.

5. The ratio of the manufacturing cost of the above structure to the selling price of the crystal ball itself is too high and does not correspond to the economics needed in the product's structure.

SUMMARY OF THE PRESENT INVENT

In view of the various impractical defects of the above described conventional rotary type crystal ball, the present inventor endeavored to research and discover the above described defects. As a result, a new design was created which has an improved structure. The primary object is to enable the driving structures of the present invention to rotate the rotary disc smoothly and effectively under a larger change of the environmental temperatures. These temperatures range from the highest temperature of 60° C. in the container during the summer time (which can exist during transportation) to the lowest environmental temperature of −20° C. (which can occur in the frigid zone). The standard of conventional equipment design is set for a temperature range of 50° C. to −10° C.

Another object is to enable the rubber plug to have a larger elastic allowance. This is accomplished by designing the fixed base to have an inclined angle where it contacts the rubber plug at its periphery with an inwardly inclined angle. This will enable the rubber plug to have a large elastic allowance so that when pressed the rubber plug will not separate from the glass ball thus causing water leakage.

An advantage of the present invention, is that in the operation of a crystal ball, the drive shaft easily engages the elastic axle, even if the alignment of their central axes has become slightly eccentric or skewed during assembly. Such misalignments will not affect the smooth rotation, and these increased tolerances will thereby increase production efficiency. Moreover, the manufacturing cost of the components of the invention can be quite low, thus greatly reducing the production cost. These are other objects and advantages of the invention.

The present invention essentially utilizes the design of an inclination of the periphery of a fixed base. The inclination is selected to match the design of the combined allowance of an elastic axle coupling and drive shaft. In this way the expansion and contraction of the clear water in the crystal ball of the present invention from hot and cold temperature changes, which in turn affects the state of protruding or hollowing of a rubber plug mounted in the fixed base, will not affect the normal rotation of the rotating components, or cause any leakage past the edge of the rubber plug as a result of the compression of the fixed base against the rubber plug.

BRIEF DESCRIPTION OF THE DRAWINGS

FIG. 4-1 is a drawing of the positional relationship of the elastic claws and the driving claws.

The detailed contents of the invention will be illustrated in the attached drawings with detailed descriptions as follows:

DETAILED DESCRIPTION OF THE PREFERRED EMBODIMENT

Figure 1:
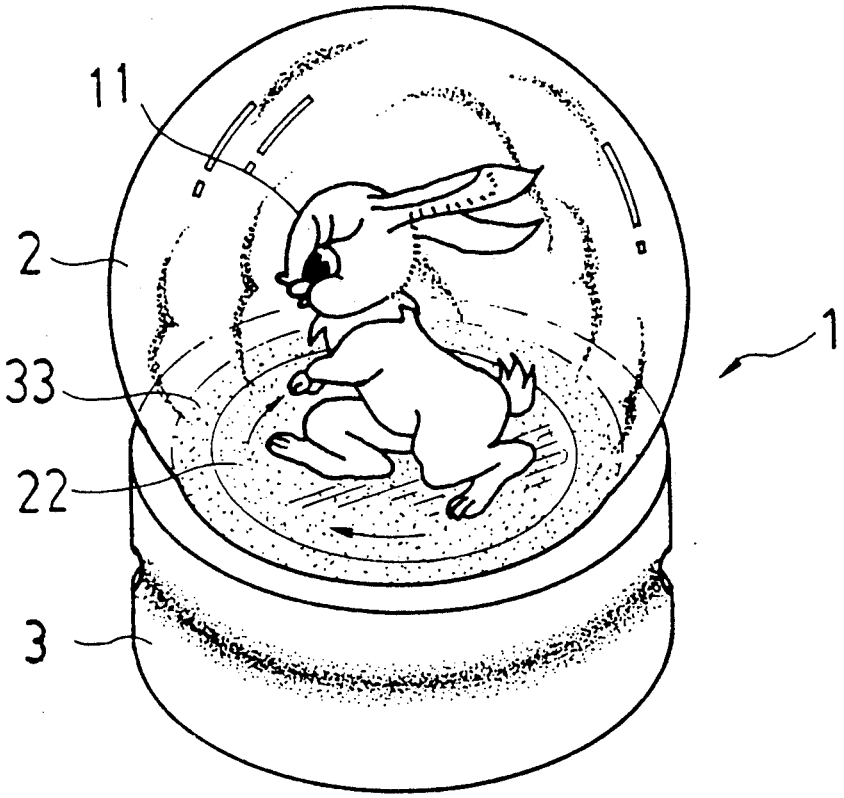
FIG. 1 is a perspective, external view of the present invention.

Referring to FIG. 1, a crystal ball 1 in accordance with the present invention is comprised of a water-filled circular glass ball 2 mounted on the surface of a wooden base 3. Between wooden base 3 and glass ball 2 there is provided a fixed base 33 which mounts a rotary disc 22 on the surface of fixed base 33. The dynamic force of a spiral wound power spring of a musical bell 4 mounted inside wooden base 3 rotates rotary disc 22. A decorative article 11, fixed on the rotary disc 22, rotates therewith, thus forming a beautiful scene within crystal ball 1.

Figure 2:
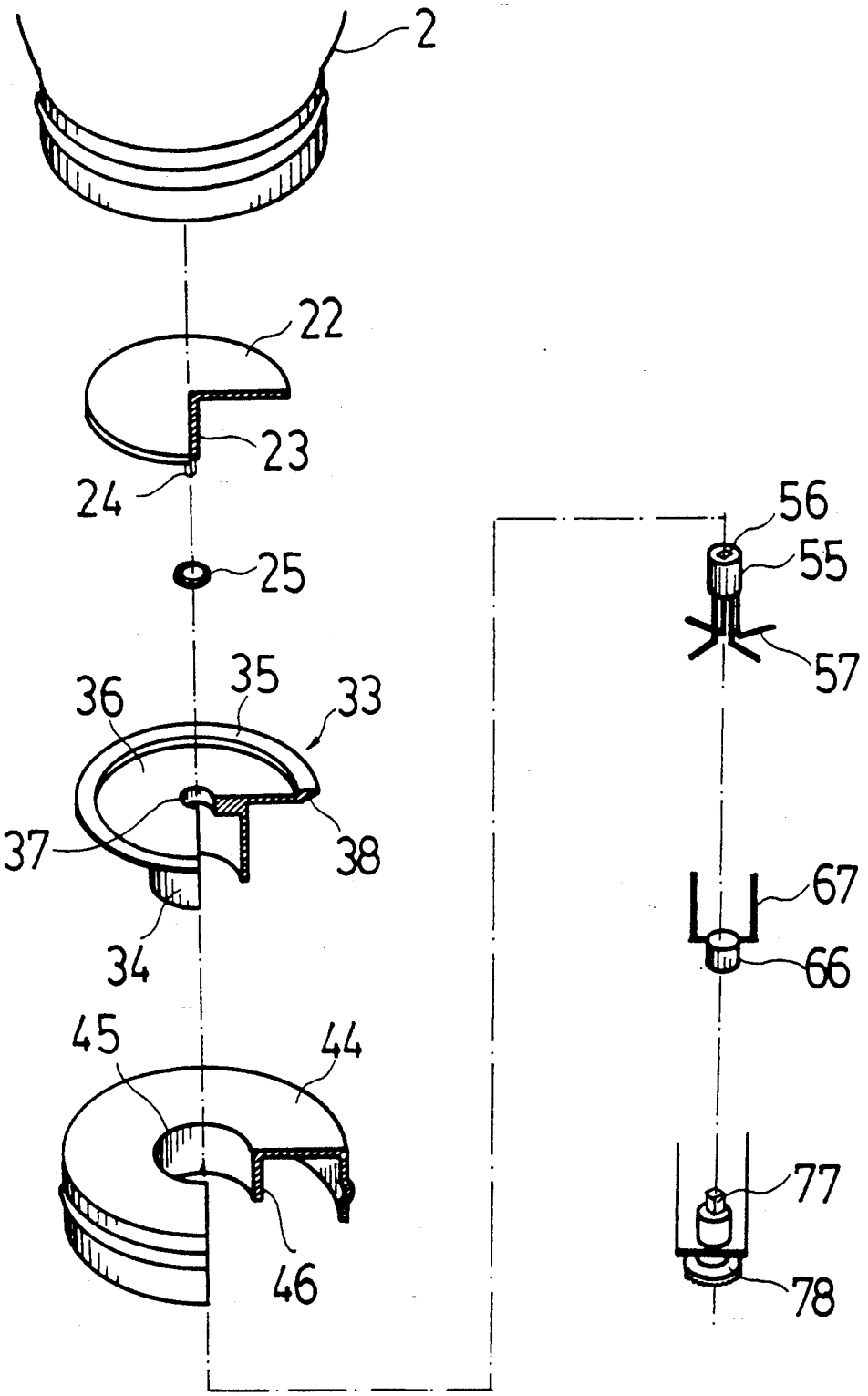
FIG. 2 is an exploded perspective view, partly in cross-section, of the assembly of the present invention.
Figure 3:
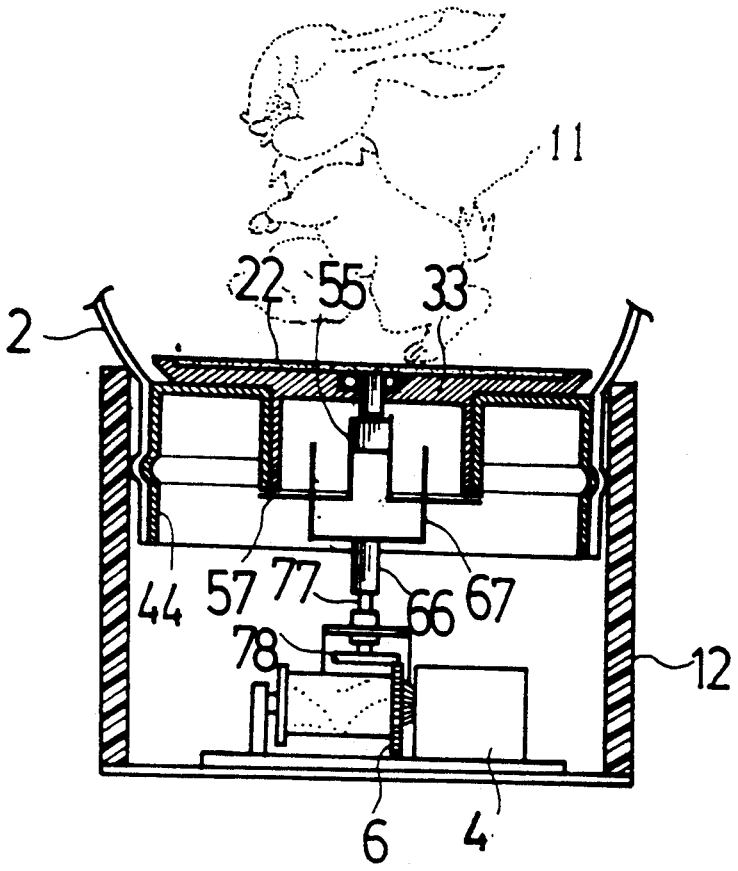
FIG. 3 is a side cross-sectional view depicting the main components of the invention.

The detailed inner structure of the present invention is shown in FIGS. 2 and 3. Rotary disc 22 is a circular flat plate having a central axle 23 fitted on the lower side at its center. Axle 23 has a square post 24 on the terminal portion thereof. Fixed base 33 also has a circular surface 35 and in addition it has a fixed depending neck 34 at its bottom. Neck 34 is tightly jointed to a central fixed hole or orifice 45 in a rubber plug 44. A concave groove 36 is provided on circular surface 35 of fixed base 33, and the diameter of circular surface 35 is the same as that of the rotary disc 22. In the center of base circular surface 35 there is a central hole 37 in which there is mounted an oil or liquid seal 25 so that the central axle 23 of rotary disc 22 combines rotary disc 22 and fixed base 33 as an integral body with central axle 23 extending through liquid seal 25. Liquid seal 25 prevents the clear water from leaking and enables smooth rotation of axle 23. In addition, a beveled edge or inclined angle 38 is provided at the lower edge of the periphery of circular surface 35 of fixed base 33. The function of this arrangement is discussed below.

Fixed base 33 has a depending fixed neck 34 at its bottom that is tightly jointed in a fixed hole 45 in rubber plug 44. After the insertion of fixed base 33 into rubber plug 44, the combination becomes an integral body. Rubber plug 44, in turn, engages glass ball 2 which has been fully filled with clear water; thus achieving the first stage process of assembly of the invention, as shown in FIG. 3.

Figure 4:
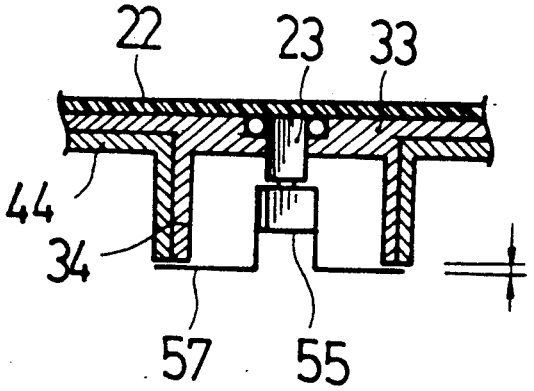
FIG. 4 is a schematic drawing of the positional relationship of the elastic claws and the fixed neck.
Figures 1, 4:
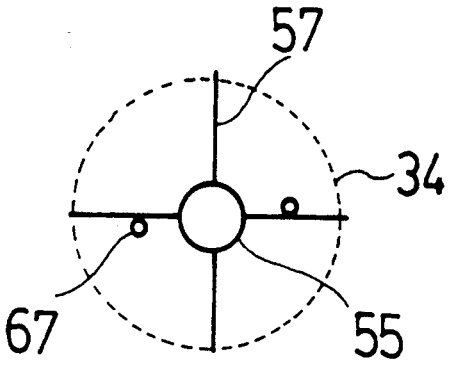
Figure 5:
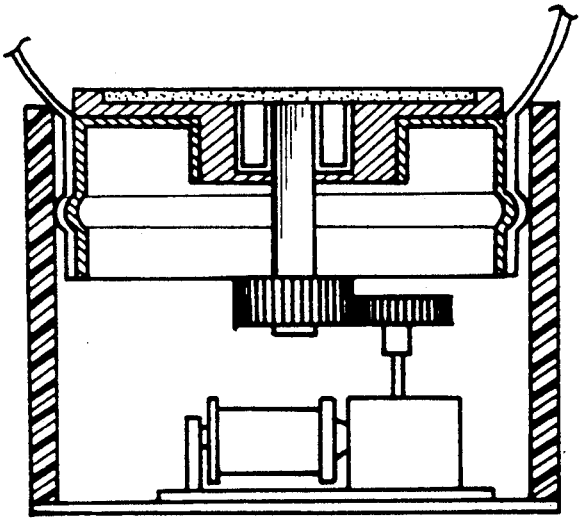
FIG. 5 is a side cross-sectional view of a conventional rotary type crystal ball.

Also, an elastic axle coupling 55 is provided with a diameter larger than that of central axle 23 of the rotary disc 22. Axle coupling 55 has a square hold 56 in its upper end that has a configuration such that it is tightly fitted onto square post 24 on the terminal end of central axle 23. The other end of axle coupling 55 has four L-shaped elastic claws 57 depending therefrom. Claws 57 have uniform angular spaces provided at the bottom end of elastic axle 55 (as shown in FIGS. 3, 4 and 4-1), and the diameter contained within the terminal end of the base of each elastic claw is about equal to that of the fixed neck 34 of fixed base 33 (as shown in FIG. 4-11). Square hole 56 of elastic axle coupling 55 is tightly fitted onto the square post 24 of rotary disc 22, and after assembly there is a space of about 0.5 m/m to 1.0 m/m between the top of the bases of elastic claws 57 and the bottom of fixed neck 34 in order to avoid any friction between them.

After the above described first stage process of assembly is completed, there are some air bubbles remaining between rotary disc 22 and fixed base 33. It is therefore necessary to thrust first elastic axle coupling 55 to discharge the air bubbles. Since the diameter of elastic axle coupling 55 is larger than that of the central axle 23, after moving a certain distance, elastic axle coupling 55 will ram into the bottom of fixed base 33 and cannot continue to move on. Thus, central axle 23 will not be pushed away from liquid seal 25, as the central axle 23 is forced to move by the thrust of the elastic axle coupling 55, i.e., the circular surface of the rotary disc moves away from the fixed base 33 so that the air bubbles can readily be discharged. After the air bubbles are discharged, the original assembly position can be resumed just by pulling elastic claws 57 downwardly.

At present, there are two ways to use or couple the spiral power spring of the musical bell as the dynamic force. One way is to couple directly the axle of the power spring (as shown in the prior art of FIG. 5). This type of coupling is characterized in that the transmission power is large but the rotational speed is slower and the number of rotations is only 4–5 revolutions per minute. The other type of coupling (FIG. 3) utilizes a crow gear 78 driven by a large drive gear 6 on one side of the musical disc for speed reduction. This type of coupling 15 characterized in that the transmission power is smaller, but the rotational speed is faster. However, in the present invention the diameter of the crown type gear has been changed to be larger so that the transmission power and the rotating speed can both be properly matched.

Crown gear 78 has a main drive shaft 77 in the shape of a square post. The upper terminal end of main drive shaft 77 is jointed to a coupling drive shaft 66. On the upper end of coupling drive shaft 66 there is a pair of opposite driving claws 67. The diameter between driving claws 67 is about a half of that of the diameter of the above described elastic claws 57. The assembled configuration is shown in FIG. 4-1, wherein the axial positions of the driving claws 67 and elastic claws 57 are shown as being mutually overlapped so that power is transmitted from driving claws 67 to elastic claws 57. The length of driving claws 67 is selected so that the height of the top of the driving claws 67, after assembly, is about half way of the length of fixed neck 34. Thus the shapes and structural positions of driving claws 67 and elastic claws 57 are known, and during the assembly process, it will be easy to position the combination. In the event there is some eccentricity or misalignment in the central axis of the central axle 23 and the driving shaft 66, it will not affect the smooth rotation of both claws 67 and 57.

The spacing between the elastic claws 57 and the fixed neck 34 stated above to be about 0.5 m/m to 1.0 m/m, is the most important tolerance to be achieved during the assembly process. If the driving claws 67 axially contact the elastic claws 57, the latter will certainly be pushed upwardly, thus causing a forward displacement of the rotary disc 22. The result of such displacement will form a gap between rotary disc 22 an fixed base 33, and such spacing could easily be occupied by snowflakes in the crystal ball 1. This could cause troubles in the rotatability of rotary disc 22 or affect the visual sense of beauty of the crystal ball 1. Hence, the above specified space of 0.5 m/m to 1.0 m/m (see FIG. 4) between elastic claws 57 and fixed neck 34 is important so that if driving claws 67 ram elastic claws 57, the upward movement of the elastic claws 57 and rotary disc 22 is limited to the maximum distance of 1.0 m/m, and this small displacement of the rotary disc 22 will not cause the existence of the above described defects.

The design of the height of the top end of the driving claws 67 being about half of that of fixed neck 34 is for the purpose of permitting expansion of the water in crystal ball 1. When the clear water in crystal ball 1 expands or shrinks as a result of changes in the environmental temperature, the resulting changes in the water pressure is absorbed by rubber plug 44. That is, rubber plug 44 will protrude or bellow accordingly and the above described design will prevent driving claws 67 from separating or disengaging from elastic claws 57 upon expansion or being squeezed by fixed base 33 upon contraction for the full range of environmental temperatures from 60° C. to −20° C.

In summing up, the invention principally utilizes the design of the inclination of the circular periphery of the fixed base to match the design of the elasticity allowance of the shapes and structural positions of the elastic axle coupling 55 and the driving shaft so that the crystal ball of the invention can be subjected to greater changes in the environmental temperature and still maintain a normal rotation and avoid leakage of water through the edge of the rubber plug. Indeed, this is the most ideal and practical structural improvement of the rotary type crystal ball and moreover, it results in a greatly reduced manufacturing cost.

What is claimed is:

1. An improved rotary crystal ball that comprises a stand;

a music box having a main drive shaft, said music box being mounted to said stand;

a rotary disc having a circular disc upper surface and a depending central axle, said axle having a lower terminal portion that has a square cross-section;

a fixed base having a circular disc having an upper disc surface with substantially the same diameter of said rotary disc, a depending fixed neck portion integral with the bottom of said circular disc and having a bottom surface, a central orifice through said disc and fixed neck portion, and an annular lip portion concentrically integral around said circular disc, said lip portion having a bevelled edge that inclines downwardly, the rotary disc being mounted on said upper disc surface, said axle passing through said central orifice of said circular disc;

a resilient plug mounted at the lower side of said fixed base and having a central plug orifice therethrough, said central plug orifice having a diameter such that fixed neck portion is tightly received therein;

an elastic axle located at a lower side of said rotary disc and tightly mounted onto said lower terminal portion of said central axle, the lower end of said elastic axle being provided with four equiangularly spaced elastic claws having terminal end portions which together define a diameter, said diameter being such that said elastic claws at least partially overlap the bottom surface of said fixed neck portion; and a crystal ball drive shaft located at a lower side of said elastic axle and connected to the main drive shaft of the music box, an upper end of said crystal ball drive shaft being provided with two opposed driving claws having terminal end portions which define a diameter that is about half of the diameter defined by said elastic claws, an axial height of said driving claws terminal end portions extending upwardly to about the middle of said fixed neck portion and thereby overlapping said elastic claws;

whereby upon rotation of said main drive shaft, said main drive shaft rotates said crystal ball drive shaft, which in turn rotates said elastic axle and said rotary disc connected thereto.

2. The improved rotary crystal ball as claimed in claim 1 wherein a space between said elastic claws and said fixed neck is maintained in the range of about 0.5 mm to 1.0 mm.

3. The improved rotary crystal ball as claimed in claim 1 wherein the diameter of aid elastic axle is larger than that of said rotary disc central axle.

4. The improved rotary crystal ball as claimed in claim 1 wherein said elastic claws have an L-shape.

5. The improved rotary crystal ball as claimed in claim 1 wherein said crystal ball also includes a glass ball having a substantially spherical portion and a depending neck portion integral therewith and mounted in said stand, and wherein said lip portion of said fixed base is spaced from the interior of the glass ball and said resilient plug forms a fluid tight seal between the glass ball neck portion and said fixed disk.

6. An improved rotary crystal ball that comprises a stand;

a music box having a main drive shaft, said music box being mounted to said stand;

a rotary disc having a depending central axle, said axle having a lower terminal portion;

a fixed base having a circular disc having an annular lip portion, said rotary disc being mounted on said circular disc;

a depending fixed neck portion integral with the bottom of said circular disc and having a bottom surface, and a central orifice through said disc and fixed neck portion, said central axle of said rotary disc passing through said central orifice of said circular disc;

a resilient plug mounted at a lower side of said fixed base;

an elastic axle coupling located a lower side of said rotary disc and rigidly connected to said rotary disc terminal portion, a lower end of said coupling being provided with a plurality of angularly spaced elastic claws having terminal end portions which together define a diameter, said diameter being such that said elastic claws at least partially overlap the bottom surface of said fixed neck portion; and a crystal ball drive shaft located at a lower side of said elastic axle and connected to the main drive shaft of the music box, an upper end of said crystal ball drive shaft being provided with two opposed driving claws having terminal end portions which define a diameter that is about half of the diameter defined by said elastic claws, an axial height of said driving claws terminal end portions extending upwardly to about the middle of said fixed neck portion and thereby overlapping said elastic claws; whereby upon rotation of said main drive shaft, said main drive shaft rotates said crystal ball drive shaft, which in turn rotates said elastic axle and said rotary disc connected thereto.

7. The improved rotary crystal ball as claimed in claim 6 wherein a space between said elastic claws and said fixed neck is maintained in the range of about 0.5 mm to 1.0 mm.

8. The improved rotary crystal ball as claimed in claim 6 wherein the diameter of said elastic axle is larger than that of said rotary disc central axle.

9. The improved rotary crystal ball as claimed in claim 6 wherein said elastic claws have an L-shape.

10. The improved rotary crystal bass as claimed in claim 6 wherein said lip portion has a bevelled edge that inclines downwardly.

* * * * *

UNITED STATES PATENT AND TRADEMARK OFFICE

CERTIFICATE OF CORRECTION

PATENT NO. : 5,088,218

DATED : February 18, 1992

INVENTOR(S) : Jian Ho LIU

It is certified that error appears in the above-identified patent and that said Letters Patent is hereby corrected as shown below:

Column 4, line 59, change "an" to --and--.

Claim 6, line 19, after "located" insert --at--.

Signed and Sealed this

Twenty-seventh Day of September, 1994

*Attest:*

*Attesting Officer*

Bruce Lehman

BRUCE LEHMAN

*Commissioner of Patents and Trademarks*